US007465059B1

(12) United States Patent
Galvez

(10) Patent No.: US 7,465,059 B1
(45) **Date of Patent: *Dec. 16, 2008**

(54) MAIN AND MINIATURE LIGHT SOURCE APPARATUS

(75) Inventor: James M. Galvez, San Dimas, CA (US)

(73) Assignee: National Electric Manufacturing Corporation, Commerce, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/821,694

(22) Filed: Jun. 25, 2007

(51) Int. Cl.
*F21L 4/02* (2006.01)

(52) U.S. Cl. ..... 362/184; 362/376; 362/378

(58) Field of Classification Search ..... 362/184, 362/194, 195, 197, 199, 207, 202, 203, 249, 362/376, 378, 399, 287, 427
See application file for complete search history.

(56) References Cited

U.S. PATENT DOCUMENTS 5,558,430 A * 9/1996 Booty, Jr. ..... 362/184
2004/0228124 A1* 11/2004 Reiff et al. ..... 362/184

* cited by examiner

*Primary Examiner*—Bao Q Truong
(74) *Attorney, Agent, or Firm*—William W. Haefliger

(57) ABSTRACT

A hand-held illuminator apparatus comprising in combination, an elongated body including a hand held section, a main light source carried by the body in spaced relation to the hand held section, circuitry in the body to supply electrical current to the light source, and a miniature light source carried by said apparatus to direct auxiliary light independently of light projection by the main light source.

10 Claims, 4 Drawing Sheets

MAIN AND MINIATURE LIGHT SOURCE APPARATUS

BACKGROUND OF THE INVENTION

This invention relates generally to use of hand-held illuminator apparatus, and more particularly to provision of multiple lights and other utilities for such apparatus.

There is need for enhancing the utility of illumination apparatus in work environments, as in auto repair and other workshops. In particular there is need for extending the lighting capabilities of such apparatus, and for use of such apparatus for small tool or parts storage, during lighting. No prior apparatus of which I am aware provides the highly advantageous features of construction, modes of operation and results as are now provided by the present invention.

SUMMARY OF THE INVENTION

It is a major object of the invention to provide a solution for the above need. Basically, the hand-held illuminator apparatus comprises:

a) an elongated body including a hand held section, b) a main light source carried by the body in spaced relation to the hand held section, c) circuitry in said body to supply electrical current to the light source, d) and a miniature light source carried by the body to be manually accessible at the body exterior.

As will appear, the miniature light source may be swingably attached to the body; and the body may provide a recess to protectively receive the miniature light source.

Another object includes providing a miniature light source in the form of a small housing sized to be captivated by the illuminator body, and having one or more LEDs carried by the small housing.

A further object includes provision of a magnetic pad on the body, the pad preferably carried on a hand held section of the body, that hangs at a lower elevation when the body is suspended at its upper distal end, for ease of tool or parts application to and removal from the pad.

Yet another object is to provide for miniature light source detachable carriage by the body, to be removed for independent use.

These and other objects and advantages of the invention, as well as the details of an illustrative embodiment, will be more fully understood from the following specification and drawings, in which:

DRAWING DESCRIPTION

DETAILED DESCRIPTION

Figure 1:
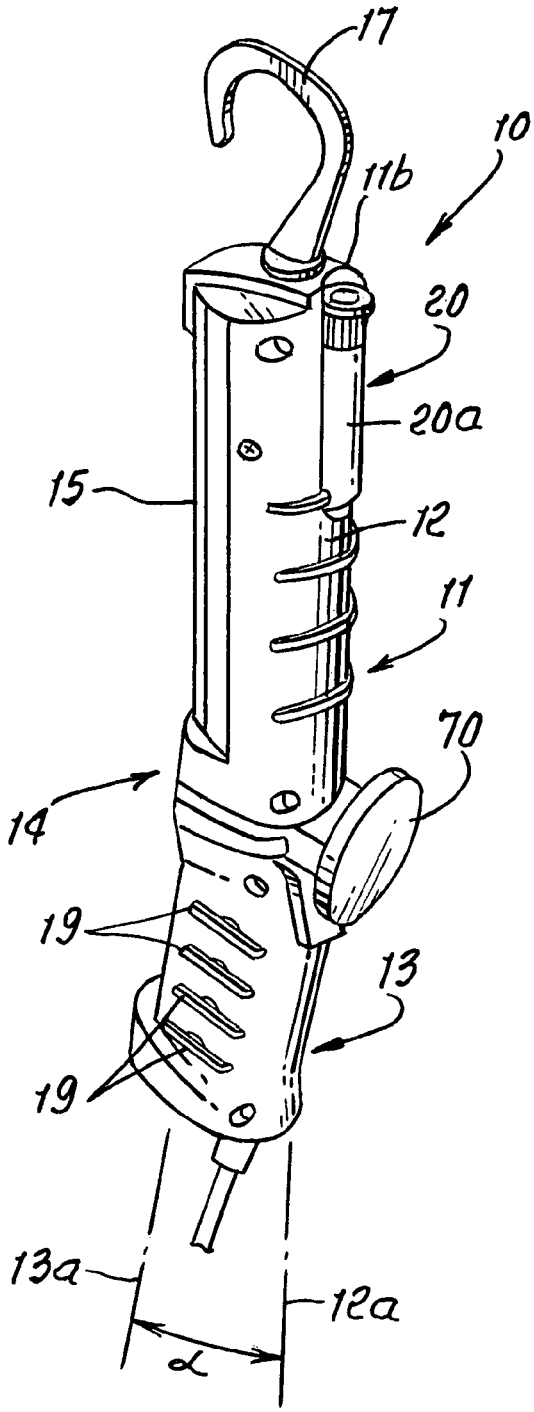
FIG. 1 is a perspective view of a main light and auxiliary light carried by the main light.
Figure 2:
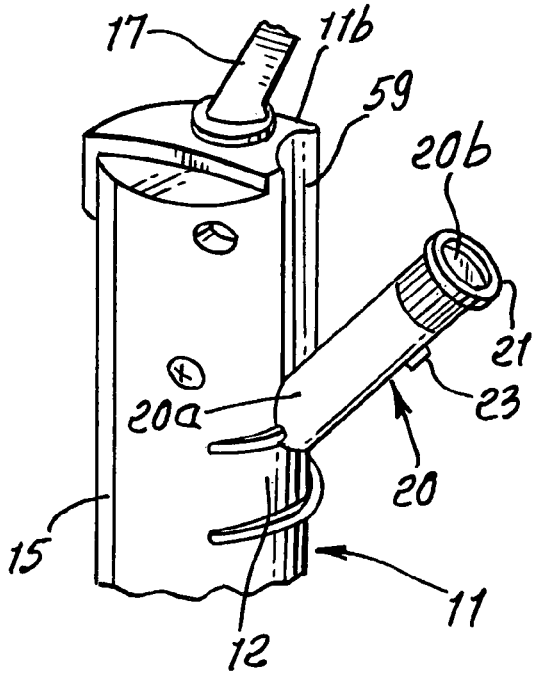
FIG. 2 is a view of the top portion of the FIG. 1 main light, with the miniature auxiliary light tilted outwardly, as by hinging.

In FIGS. 1-5, hand held illuminator apparatus 10 includes an elongated body or housing 11 defining an upper or forward illumination portion 12, a lower or rearward grip or handle portion 13, and an intermediate portion 14. An elongated electrical lamp is carried within portion 12 to project light laterally through elongated lens 15. One or two magnetic ballasts are typically carried within the housing to selectively energize the lamp or lamps, and a switch or switches are carried by the housing to control energization of the lamp, which may be fluorescent lamps. See in this regard the disclosure contained in U.S. patent application Ser. No. 10/438,430 incorporated herein by reference. Elongated handle portion 13 extends at an angle $\alpha$ that lies between 4° and 15°, and as measured between axes 13*a* and 12*a* of 13 and 12.

A magnetic pad or plate 16 is attached or presented at one side of the handle portion, for retention or storage of small steel parts such as screws, washers, tools, brackets, etc. as used by a worker, when the light is suspended by hook 17 at the work site, for example vehicle engine repair. The worker can readily and easily magnetically store such parts on the pad, and remove them for use, and such parts can be shifted on the pad to positions of non-interference with the worker's fingers as he grips the handle. See also the rubber grip protrusions 19 longitudinally spaced along the opposite side of the handle and extending transversely in FIGS. 1 and 5, to aid in manual gripping of the handle.

A miniature, auxiliary light or flashlight source 20 is carried by the upper portion of the body or housing, as shown in FIGS. 1-4, and to be easily manually accessed at the body exterior, in spaced relation to the lens 15. See also lens 20*b* of 20. Structure is provided to protect preferred miniature light elongated housing 20*a* in its association with main housing upper portion 12. One such structure comprises an elongated concave recess 59 sunk in the body 11 and extending upwardly so that the light projecting end 21 of the source 20 is directed longitudinally proximate the upper end 11*b* of the main housing 11. When light source 20 is turned on, for example by a switch 23, it directs light longitudinally, and thereby assists area illumination provided via main lens 15.

Figure 3:
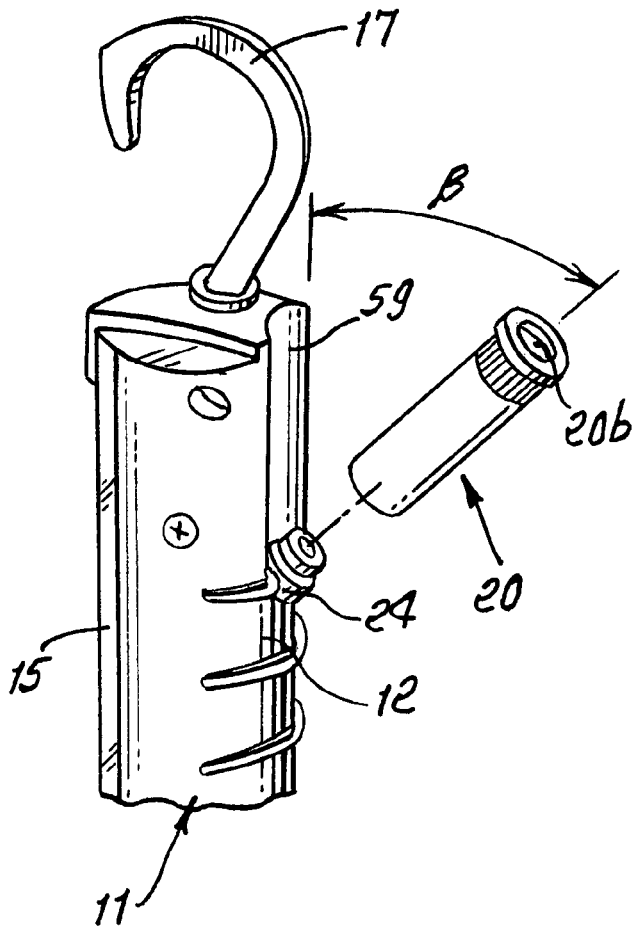
FIG. 3 is a view like FIG. 2, but showing removability of the auxiliary light for auxiliary use.
Figure 4:
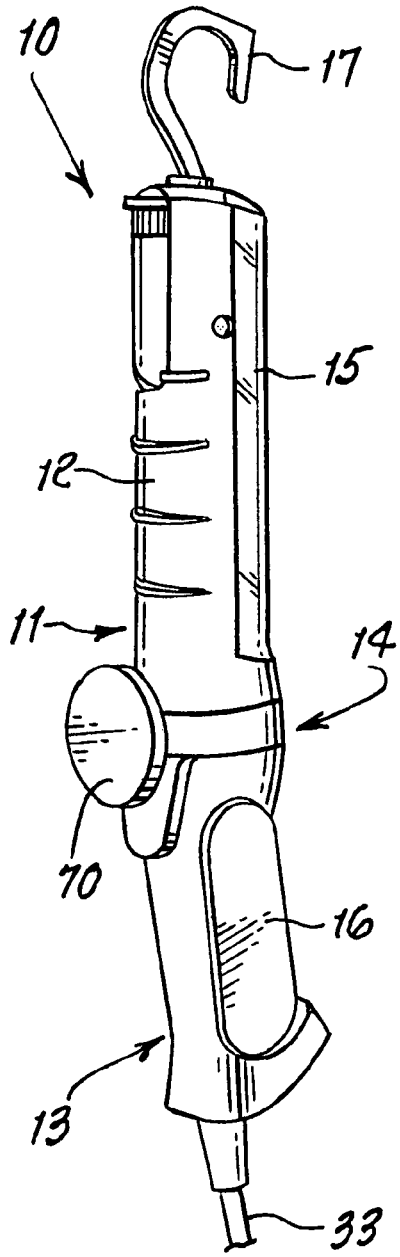
FIG. 4 is a perspective view of the opposite side of the main light of FIG. 1, and showing a magnetic pad associated with the light handle.

The miniature light source typically includes an internal LED for illumination, and battery energized circuitry within housing 20*a* for energizing the LED. The direction of light projection may be varied, as when the lower end of the housing 20*a* is supported, as by hinge connection at 24, at angle $\beta$ which may be between 10° and 60° for example, to the main housing 11. See for example the outwardly swing position of the miniature light source 20 in FIG. 2, as accommodated by hinge connection 24. This of course varies the direction of light projection by source 20, relative to light projection transversely through main lens 15. FIG. 3 shows provision for optional endwise disconnection of the miniature light source body 20*a* from the supporting connection 24, to enable use of source 20 independently of the main light sources, for example as the workman requires close illumination of vehicle engine lower areas not directly illuminated by light from the lens 15, as when the apparatus is hook supported above the engine location.

Figure 5:
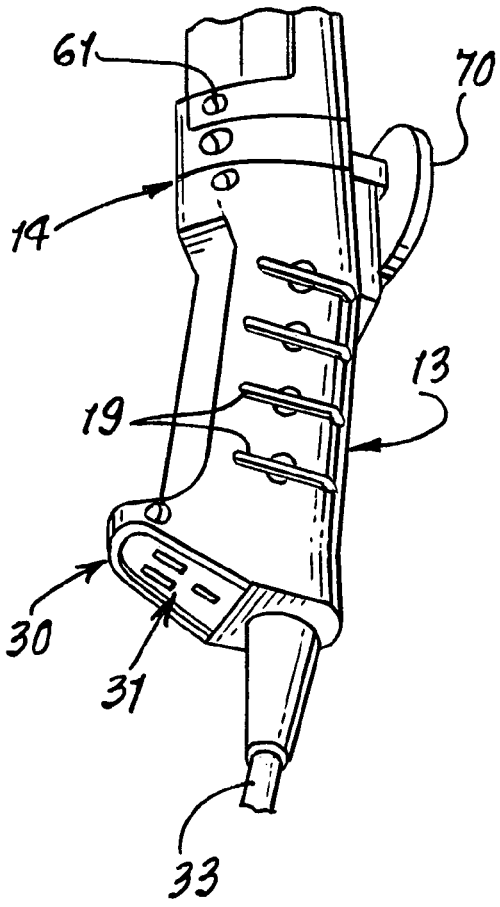
FIG. 5 is an enlarged perspective view of the FIG. 4 light handle opposite side showing an angled lowermost portion with an electrical terminal.
Figure 6:
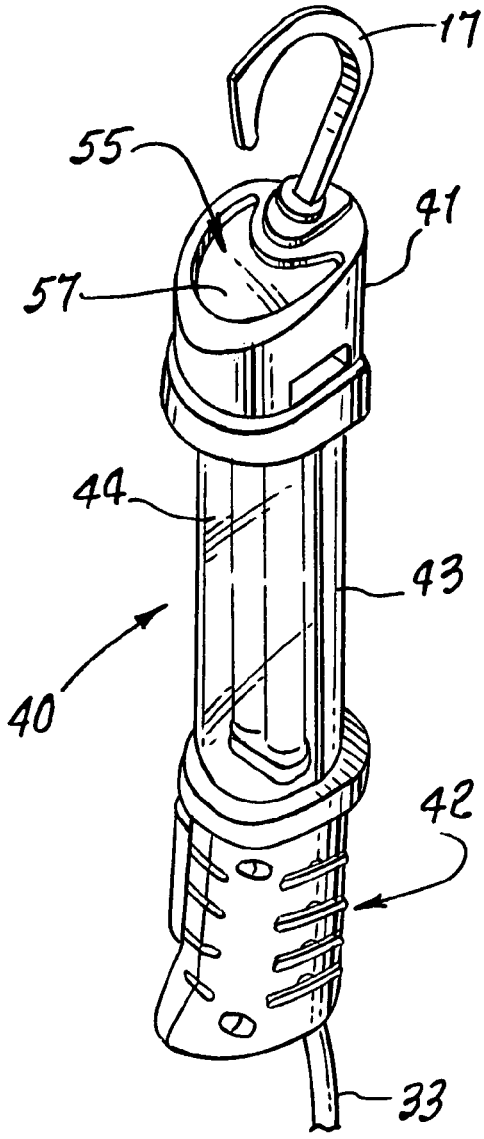
FIG. 6 is a perspective view of a modified main light showing an illuminating top lens cap.
Figure 7:
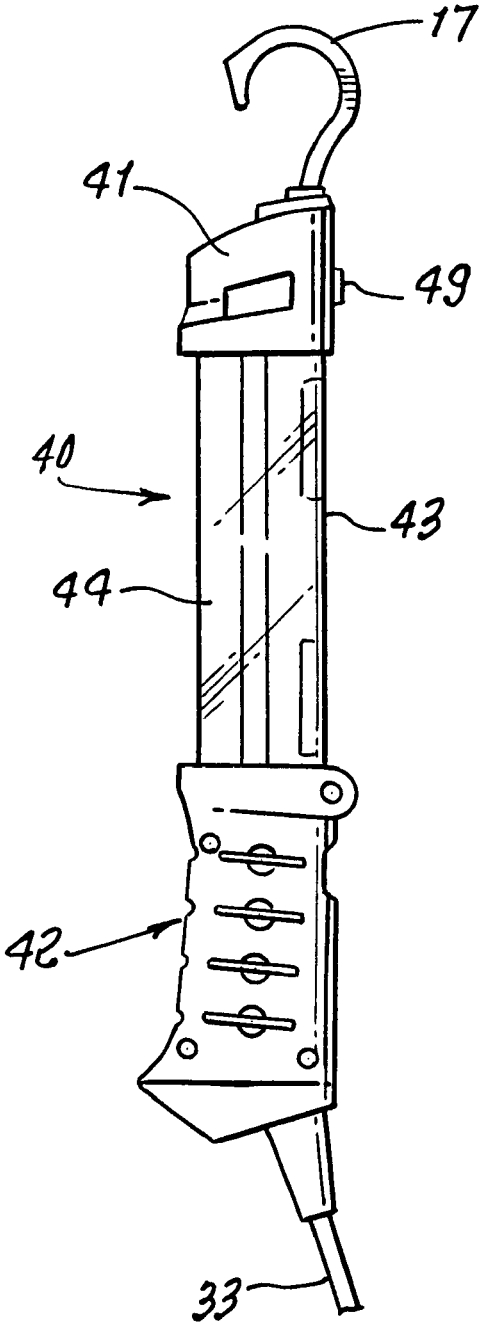
FIG. 7 is a side elevation view of the FIG. 6 light.
Figure 8:
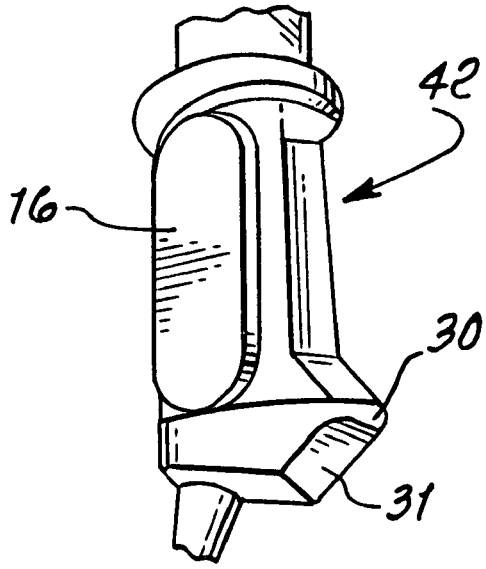
FIG. 8 is a perspective view of one side of the handle portion of the FIG. 6 light, and having a magnetic pad.
Figure 9:
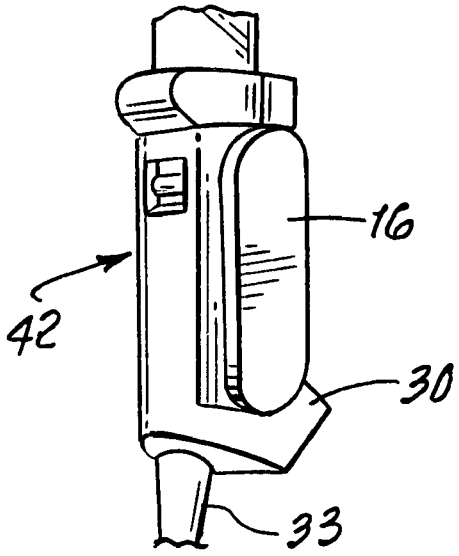
FIG. 9 is a perspective view like FIG. 8, but taken to show the opposite side of the handle portion of FIG. 8.

FIG. 5 shows an angled, transversely and upwardly angled terminal 30 of the handle portion 13 to support the lower portion of the user's hand while gripping the handle. Such angling also provides ready access to an auxiliary electrical terminal 31 usable for plug-in electrical connection of or to other electrical lights or tools. Electrical power is supplied to the apparatus as via cable 33.

FIGS. 6-9 show a modified apparatus 40 with certain components bearing the same identifying numerals as applied in FIGS. 1-5. The housing is formed by upper cap section 41, and lower handle section 42 separate from 41. A strut 43 extends between sections 41 and 42, and a tubular lens 44 extends in association with that strut. LED light sources extend within the tube, in the manner as, for example, is disclosed in U.S. patent application Ser. No. 10/619,119, incorporated herein by reference.

A miniature light source is provided as at 55, with light projected as by an LED, upwardly or forwardly through a small lens 57 carried by cap section 41. It is manually accessible, as for example by small light switch 49 on the cap section to control ON-OFF operation of the auxiliary LED in the cap section, and independently of ON-OFF operation of the main LEDs projecting light transversely through the tubular lens 44.

In FIG. 5, a ratcheting magnet with a screw clamp is generally shown at 61, on section 14.

In FIGS. 1-5, a support 70 is carried at the side of the body to project away from said-section 14.

I claim:

1. A hand held illuminator apparatus comprising in combination:

a) an elongated body including a hand held section, b) first and second light sources connectable to the body in spaced relation to the hand held section, for directing light away from the body, c) one of said light sources comprising a fluorescent bulb, and the other of said light sources including at least one LED, said one light source positioned for directing light sidewardly of the body via one elongated lens at one side of the body, and the other light source positioned to direct auxiliary light independently of light projected by said one source, d) circuitry to supply electrical current to the light sources, e) said other light source including an elongated housing having opposite ends, and having swingable connection to the body proximate one of said ends, whereby light is unobstructibly directed generally lengthwise of the body in one position of the housing at another side of said body, the housing also having detachable connection to the body proximate said one end, f) said other light source housing positioned externally of, and at said other side of the body.

2. The combination of claim 1 wherein said circuitry extends in the body to supply current to a light source located within the body.

3. The combination of claim 1 wherein said light sources are each detachably connectable to the body.

4. The combination of claim 1 including lens structures associated with said light sources.

5. The combination of claim 1 wherein the light sources have means for their detachable connection to the body, proximate said lens structure.

6. The combination of claim 5 wherein one of said light sources has greater length extent than the other light source, in the direction of length of said elongated body.

7. A hand held illuminator apparatus comprising in combination:

a) an elongated body including a hand held section, b) a first light source carried by and within the body in spaced relation to the hand held section, for directing light sidewardly of the body, via an elongated lens at one side of the body, c) circuitry in said body to supply electrical current to the light source, d) and a second light source configured to be carried by said body to direct auxiliary light independently of light production by the first light source, e) said second light source including an elongated carrier having opposite ends, the carrier swingably connectable to the body proximate one of said ends whereby light is unobstructibly directed away from said body, in a housing position at another side of the body, the carrier also having detachable connection to the body proximate said one end.

8. The apparatus of claim 7 wherein one of said light sources includes a fluorescent bulb, and the other of said light sources includes at least one LED.

9. The apparatus of claim 7 wherein the carrier is substantially shorter then said elongated body.

10. A hand-held illuminator apparatus comprising in combination:

a) an elongated body including a hand held section, b) a main light source carried by and within the body in spaced relation to the hand held section, for directing light sidewardly of the body, via an elongated lens at one side of the body, c) circuitry in said body to supply electrical current to the light source, d) and a second light source configured to be carried by said body to direct auxiliary light independently of light projection by the main light source, e) said second light source including an elongated carrier having opposite ends, the carrier swingable relative to and externally of said body, and having means for optional detachable connection to the body proximate one of said ends whereby light is unobstructibly directed away from said body.

* * * * *